US006047450A

United States Patent [19]

Machacek et al.

[11] Patent Number: 6,047,450

[45] Date of Patent: Apr. 11, 2000

[54] SLIDE ZIPPER ASSEMBLY

[75] Inventors: Zdenek Machacek, Nanuet, N.Y.; Robert G. Kobetsky, Chicago, Ill.

[73] Assignee: Illinois Tool Works Inc., Glenview, Ill.

[21] Appl. No.: 09/247,676

[22] Filed: Feb. 9, 1999

[51] Int. Cl.[7] ..... B65D 33/16

[52] U.S. Cl. ..... 24/399

[58] Field of Search ..... 24/576, 577, 399, 24/400, 587; 383/63, 65, 68, 69

[56] References Cited

U.S. PATENT DOCUMENTS 4,944,072 7/1990 Robson ..... 24/576 X
5,007,143 4/1991 Herrington .
5,442,838 8/1995 Richardson et al. .
5,664,299 9/1997 Porchia et al. .

*Primary Examiner*—James R. Brittain
*Attorney, Agent, or Firm*—Pitney, Hardin, Kipp & Szuch LLP

[57] ABSTRACT

A slide zipper assembly comprising a reclosable zipper and a slider is provided. The zipper includes a first profile interlockable with a second profile. The profiles include portions which form a fulcrum about which the profiles may be pivoted to disengage the profiles. The slider straddles the zipper and has a top from which two arms depend. The inner surface of one or both of the slider arms is shaped so that as the slider is moved along the zipper in an opening direction, one or both of the profiles is pivoted about the fulcrum so as to disengage the profiles.

21 Claims, 7 Drawing Sheets

SLIDE ZIPPER ASSEMBLY

BACKGROUND OF THE INVENTION

1. Field of the Invention

The present invention relates to a zipper and a slide zipper assembly for use in plastic bags of the type in which items, such as foodstuffs, may be stored.

2. Description of the Prior Art

Slide zipper assemblies for use with plastic bags are well known in the reclosable fastener art. Examples of conventional slide zipper assemblies can be found in U.S. Pat. Nos. 5,007,143, 5,008,971, 5,131,121 and 5,664,299.

Conventional slide zipper assemblies typically comprise a plastic zipper having two interlocking profiles and a slider for opening and closing the zipper. The slider straddles the zipper and has a separating finger at one end which is inserted between the profiles to force them apart as the slider is moved along the zipper in an opening direction. The other end of the slider is sufficiently narrow to force the profiles into engagement and close the zipper when the slider is moved along the zipper in a closing direction.

Recently, slide zipper assemblies which do not make use of a separating finger have been disclosed. For example, in U.S. Pat. No. 5,809,621, a slide zipper assembly is disclosed wherein one of the zipper profiles is provided with a pair of handles which cooperates with the slider. As the slider is moved in an opening direction, the handles are squeezed together to disengage the profiles. The slider is narrower at the closing end than at the opening end.

In U.S. Pat. No. 5,442,838, a slide zipper assembly is disclosed wherein the zipper profiles are engaged and disengaged by a "rolling action". This "rolling action" is described as being achieved through cooperation between flanges on the profiles and shoulders which project inwardly from the arms of the slider. The slider shoulders are shaped throughout the length of the slider for engagement with the flanges and have a greater spacing at the closing end of the slider than at the opening end. Thus, as with other prior art slide zipper assemblies, the closing end of the slider is narrower than the opening end.

Many prior art slide zipper assemblies, however, have often proven unsatisfactory. For example, some prior art slide zipper assemblies provide for inadequate interlocking of the zipper profiles, thereby resulting in leaking of the contents of the bag. Other prior art slide zipper assemblies do not function consistently, often failing to properly interlock the zipper or smoothly open and/or close the zipper. Yet other slide zipper assemblies are of a complex design and often difficult and expensive to manufacture.

It is, therefore, the object of the present invention to provide a unique and novel slide zipper assembly for use with plastic bags which overcomes the problems associated with the prior art as discussed above.

SUMMARY OF THE INVENTION

The present invention solves the aforementioned problems by providing a novel slide zipper assembly comprising a slider and a reclosable zipper.

The zipper includes a first profile and a second profile which is interlockable with the first profile. The first profile includes an interlocking member on a surface directed toward the second profile and an integral base directed away from the second profile. Likewise, the second profile includes an interlocking member on a surface directed toward the first profile interlockable with the first profile interlocking member and an integral base directed away from the first profile. Additionally, portions of the first and second profiles form a fulcrum about which the profiles may be pivoted out of engagement when distal ends of the profile bases are forced towards each other.

As oriented on a bag having the zipper at the top, the slider has a top from which two arms depend. The slider straddles the zipper and has a closing end and an opening end. Unlike with prior art sliders, the opening end is narrower than the closing end. Additionally, the slider does not have a separating finger.

Rather, the zipper is opened by pivoting the interlocked profiles out of engagement about the fulcrum. The slider arms are shaped at the opening end to achieve this action by forcing distal ends of the profile bases towards each other as the slider is moved in the opening direction. At the closing end, the slider arms are shaped to force the profiles into engagement as the slider is moved in the closing direction. Unlike in prior art sliders, however, the closing end of the slider is wider than the opening end of the slider.

The present invention will now be described in more complete detail with reference being made to the figures identified below wherein the same numerals represent identical elements.

BRIEF DESCRIPTION OF THE DRAWINGS

In the accompanying drawings:

FIG. 5(*b*) is a cross-sectional view of the central section of the slider in accordance with the first embodiment of the present invention;

FIG. 5(*c*) is a cross-sectional view of the opening end of the slider in accordance with the first embodiment of the present invention;

FIG. 7(*b*) is a cross-sectional view of the opening end of a slider in accordance with a second embodiment of the present invention;

DETAILED DESCRIPTION OF THE PREFERRED EMBODIMENT

Figure 1:
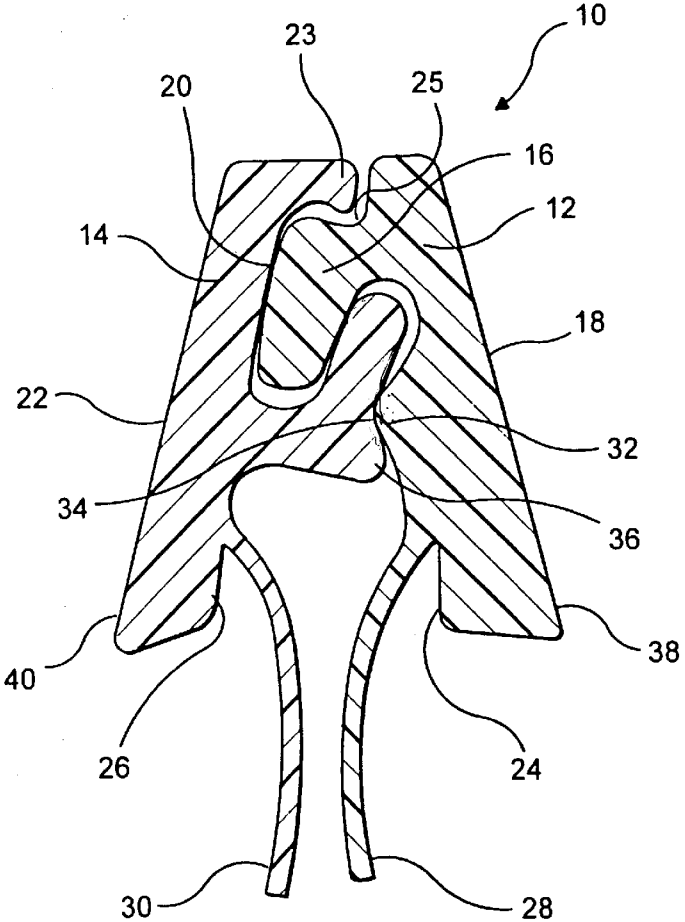
FIG. 1 is a cross-sectional view of an interlocked zipper in accordance with a first embodiment of the present invention.
Figure 6:
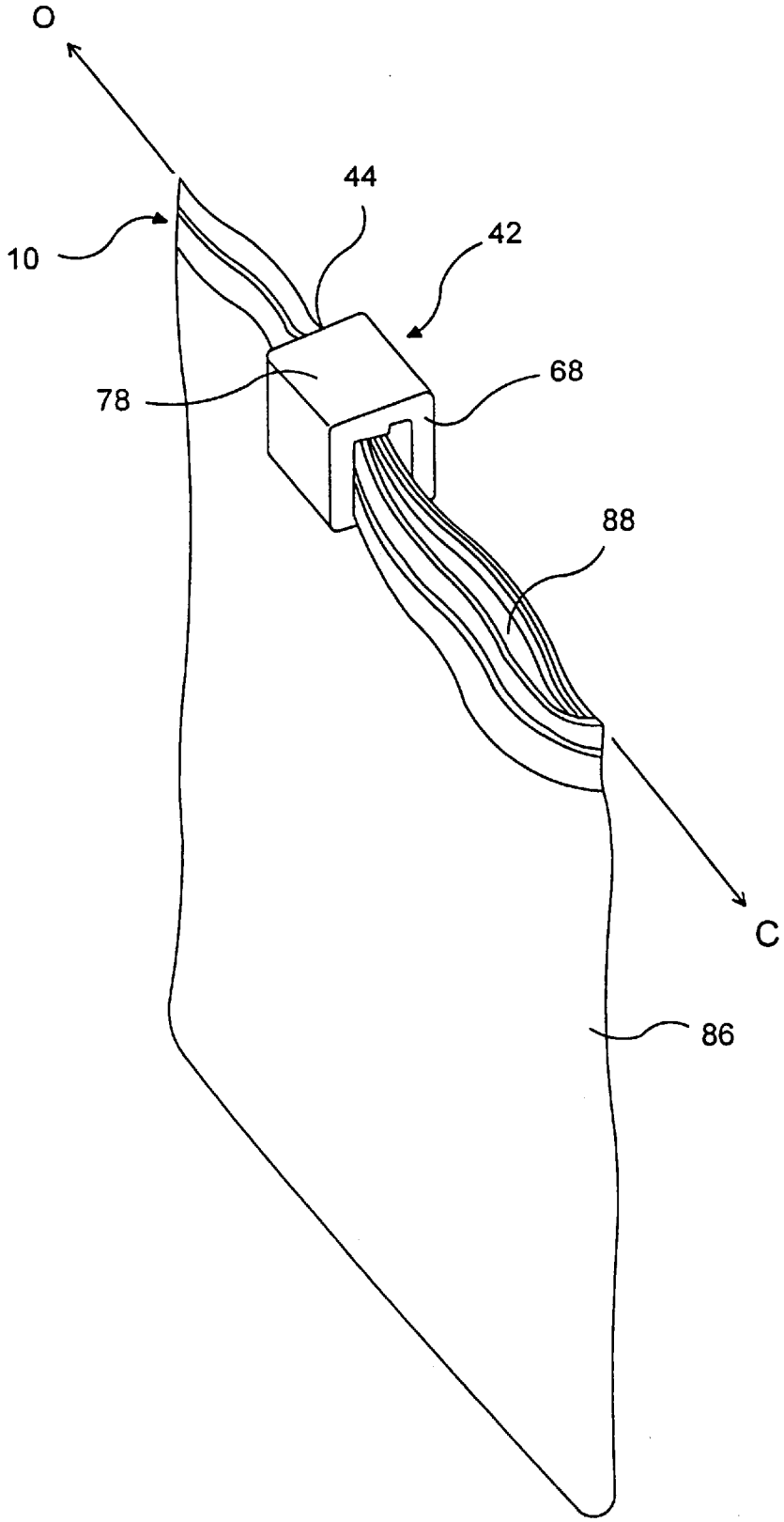
FIG. 6 is a perspective view of the slide zipper assembly in accordance with the first embodiment of the present invention disposed along the mouth of a plastic bag.

FIG. 1 shows a cross-sectional view of an interlockable zipper 10 in accordance with a first embodiment of the present invention. The zipper 10 is formed of a resilient plastic material such as polyethylene and comprises a male profile 12 and a female profile 14. The zipper 10 is disposable across the mouth 88 of a plastic bag 86, as shown in FIG. 6. For purposes of this description, the bag 86 will be assumed to be oriented with its mouth 88 on top as depicted in FIG. 6.

The male profile 12 has a male interlocking member 16 on a surface directed toward the female profile 14 and a relatively stiff base 18 directed away from the female profile 14. Similarly, the female profile 14 has a female interlocking member 20 on a surface directed toward the male profile 12 interlockable with the male interlocking member 16 of the male profile 12 and a relatively stiff base 22 directed away from the male profile 12. The close tolerances and dimensions of the male interlocking member 16 and the female interlocking member 20 ensure a tight interlock between the profiles that provides leak proof properties.

As is clear from FIG. 1, the profile bases 18, 22 are not parallel, but diverge downwardly in a manner similar to the letter "A". Because of this "A" configuration, the zipper is difficult to open from the contents side of the bag 86 since the opening force tends to push the lower extremities of the profiles apart and thereby enhance the interlock between the male interlocking member 16 and the female interlocking member 20. The zipper is sealable to the bag 86 at base extensions 28, 30.

The male profile 12 also includes a convex fulcrum member 32 which engages a concave fulcrum member 34 of the female profile 14 to form a fulcrum 36, as shown in FIG. 1. The fulcrum 36 is not equidistant between the profile bases 18, 22, but is offset closer to the male profile 12. The surfaces of the fulcrum members 32, 34 are contoured to create a leak proof seal between the interlocked profiles 12, 14 at the fulcrum 36.

Figure 3:
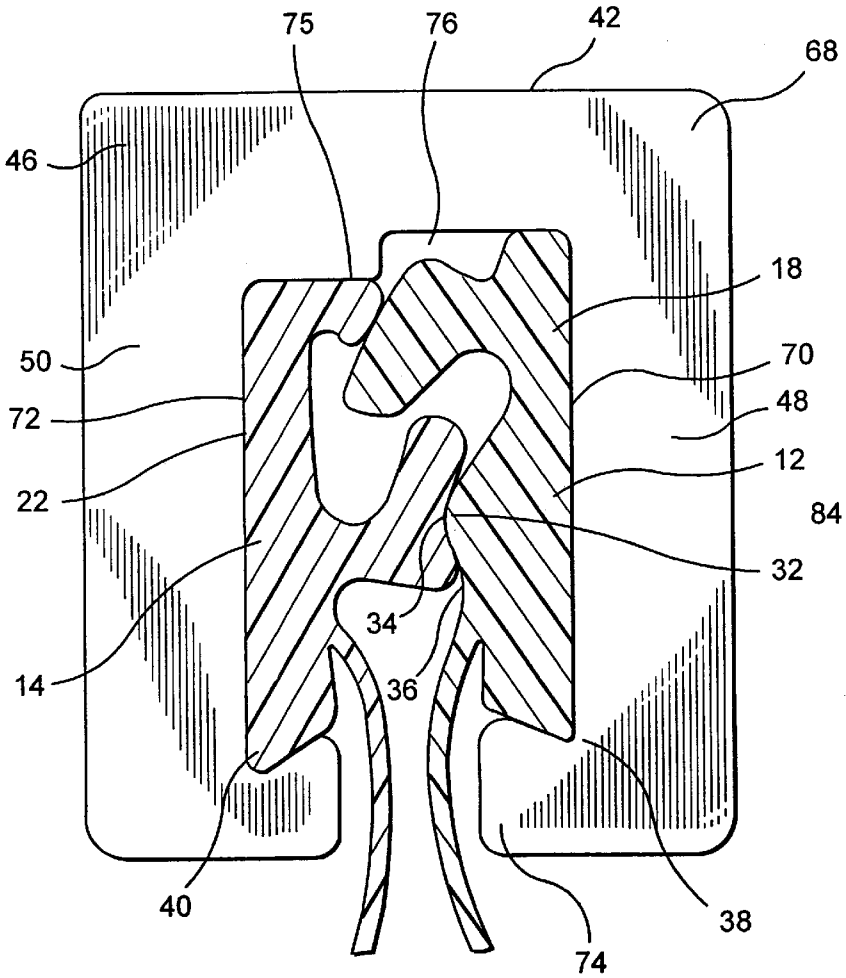
FIG. 3 is a view of the opening end of the slide zipper assembly in accordance with the first embodiment of the present invention.

When distal ends 38, 40 of the profile bases 18, 22 are forced towards each other, the resulting leverage causes the profiles to pivot oppositely about the fulcrum 36 and disengage from each other, as shown in FIG. 3. The male interlocking member 16 is shaped to readily permit easy disengagement from the female interlocking member 20. A top latch 23 on the female member 20 is resiliently releasable from the top cavity or indent 25 in the male member 16 to permit opening upon a force being created on the latch by an upper shoulder 75 on an associated slider as will be described. To ensure proper pivoting of the profiles 12, 14, the profile bases 18, 22 should be more rigid than the male and female interlocking members 16, 20. This may be achieved, for example, by making the bases 18, 22 thicker than the resilient portions of members 16, 20.

Figure 2:
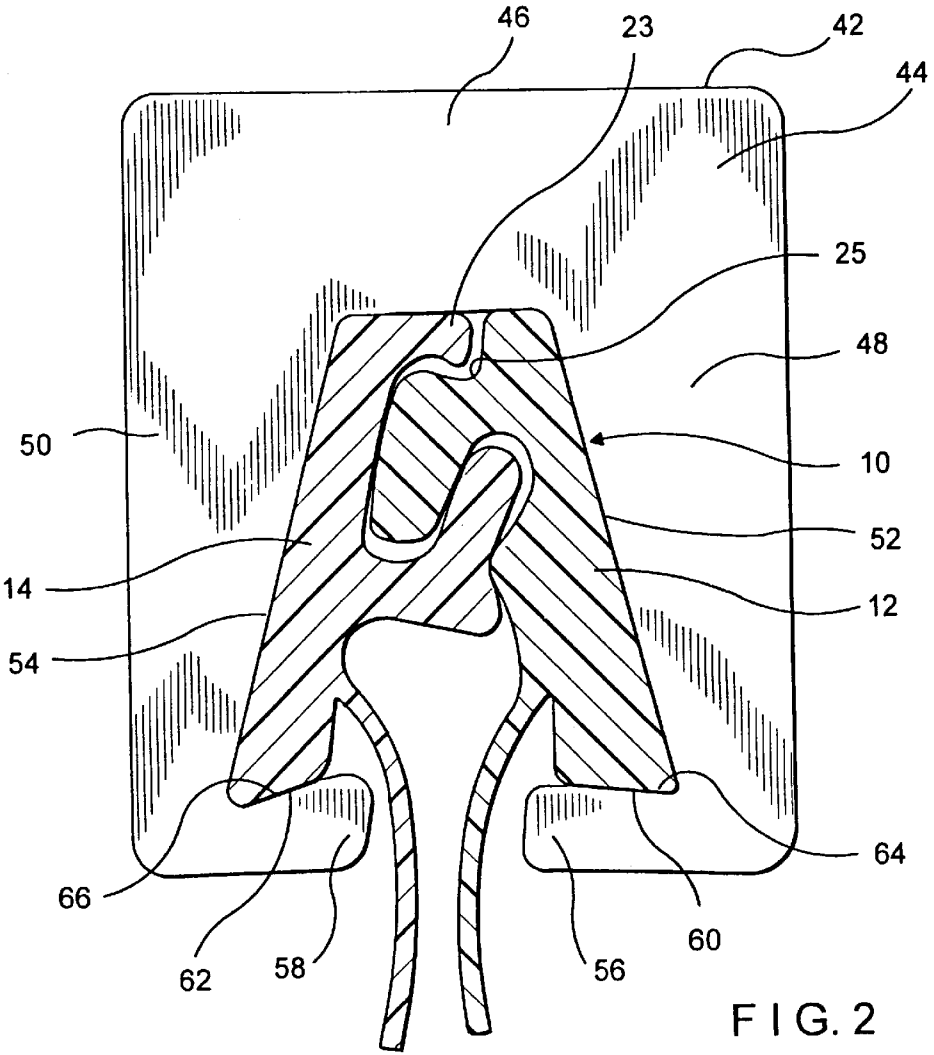
FIG. 2 is a view of the closing end of a slide zipper assembly in accordance with the first embodiment of the present invention.

To facilitate opening and closing of the zipper 10, the zipper 10 is provided with a straddling slider 42, as shown in FIG. 2. Unlike with many prior art slide zipper assemblies, which require that the zipper profiles be separated at the slider loading point, the slider 42 can be top-loaded onto the zipper without having to disengage the profiles at the loading point since the slider does not make use of a separating finger.

As shown in FIG. 6, the slider is slidable along the zipper in a closing direction "C" in which the profiles 12, 14 are engaged by the slider and an opening direction "O" in which the profiles 12, 14 are disengaged by the slider. The slider 42 is formed of a resilient plastic material, such as delrin, polypropylene, PBT, etc.

FIG. 2 depicts the closing end 44 of the slider 42 and a cross-section of the zipper 10. The closing end 44 is so-called because it is at the closing end where the zipper profiles 12, 14 are forced into engagement when the slider 40 is moved in the closing direction "C", i.e., opposite to the closing end 44.

As shown in FIG. 2, the slider 42 straddles the zipper 10 and has a top 46 from which a first arm 48 and a second arm 50 depend. The first arm 48 has an inner surface 52 and the second arm 50 has an inner surface 54. The slider arm inner surfaces 52, 54 are divergent with respect to each other in the same manner as the profile bases 18, 22 and are spaced to push the profiles 12, 14 into engagement as the slider 42 is moved along the zipper 10 in the closing direction "C".

The slider arms 48, 50 are additionally provided with retaining shoulders 56, 58 having upper surfaces 60, 62 which mate with lower surfaces 64, 66 of the profiles 12, 14. The surfaces 60, 62 and 64, 66 may be tapered to maximize their pull-off resistance. The mating of these surfaces in combination with the "A" configuration of the profiles 12, 14 prevents the slider 42 from being inadvertently pulled off the zipper 10 during use, since an upward pulling motion will tend to pull the profile bases 18, 22 apart at their distal ends 38, 40 and lock the slider 42 onto the zipper 10.

Opening of the zipper 10 is achieved when the slider 42 is moved in the opening direction "O". FIG. 3 shows the opening end 68 of the slider 42. It should be noted that for purposes of this discussion the slider 42 and the zipper 10 are shown with the same orientation in FIGS. 2 and 3. However, when one actually looks at the slider 30 and the zipper 10 from the opening end the orientations of the slider 42 and the zipper 10 will be reversed.

As shown in FIG. 3, at the opening end 68 the slider arms have inner surfaces 70, 72 which are substantially parallel, rather than divergent as at the closing end 44. Additionally, the first slider arm 48 has a retaining shoulder 74 which is thicker than the first slider arm retaining shoulder 56 at the closing end 44 and a shoulder 75 extending downwardly from the zipper top portion. The overall thickness of the slider top portion 46 measured to include shoulder 75 at the opening end (as shown in FIG. 3) is thicker than the corresponding top portion 46 measured at the closing end (as shown in FIG. 2).

As the slider is moved in the opening direction and the slider arm inner surfaces change from the "A" configuration of surfaces 52,54 to the substantially parallel configuration of surfaces 70, 72, the distal ends 38, 40 of the profile bases 18, 22 are forced towards each other, thereby forcing the fulcrum members into a tighter relationship, increasing the leak proof seal created by the fulcrum members, and causing the profiles 12, 14 to pivot oppositely about the fulcrum 36. Simultaneously, the retaining shoulder 74 on the first slider arm forces the male profile upwardly, while shoulder 75 forces the female profile downwardly causing the convex male fulcrum member 32 to cam upwardly along the concave female fulcrum member 34. Convex member 32 may have a smaller radius than concave member 34 to further facilitate the relative upward/downward movement of the profiles and to provide a point contact that enhances the sealing characteristics of the profiles. Thus, as is shown in FIG. 3, the resulting action is a simultaneous pivoting of the profiles 12, 14 oppositely about the fulcrum 36 and an upward translation of the first profile 12 relative to the second profile 14 which action results in the disengagement of the profiles, as shown in FIG. 3. A cavity 76 in the slider top accommodates the upward translation of the male profile 12.

Figure 4:
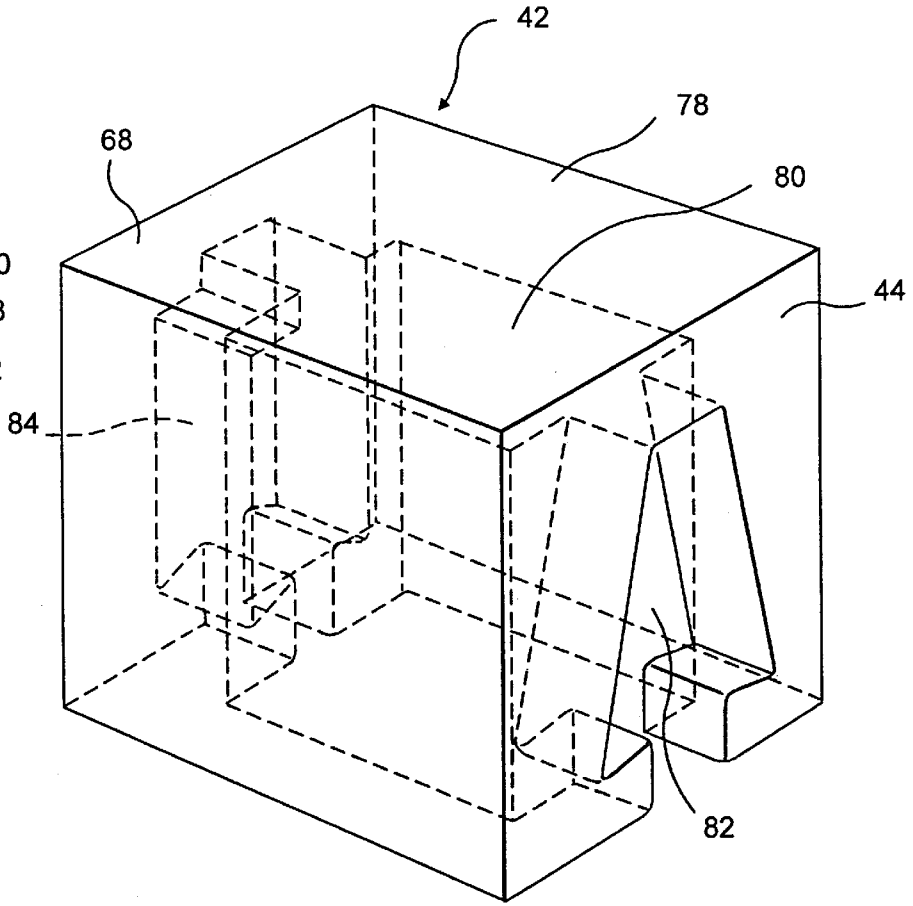
FIG. 4 is a perspective view of the slider in accordance with the first embodiment of the present invention.

The slider arm inner surfaces and retaining shoulders may or may not be continuous along the length of the slider 42. The slider arm inner surfaces and retaining shoulders are shown in FIG. 4 as being discontinuous, with a large chamber 80 being provided in a central section 78 of the slider between the opening end 68 and the closing end 44 to allow for smooth engagement and disengagement of the profiles. However, other considerations, such as ease of manufacturing, may dictate that the inner surfaces and/or shoulders be continuous.

Figure 5A:
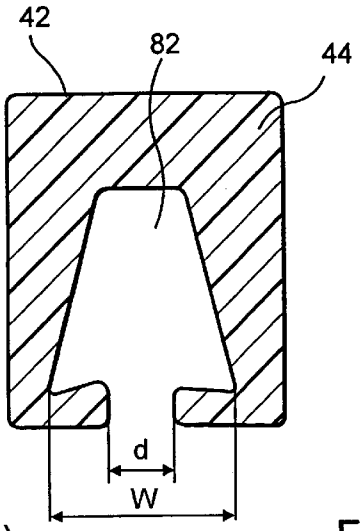
FIG. 5(*a*) is a cross-sectional view of the closing end of the slider in accordance with the first embodiment of the present invention.
Figure 5B:
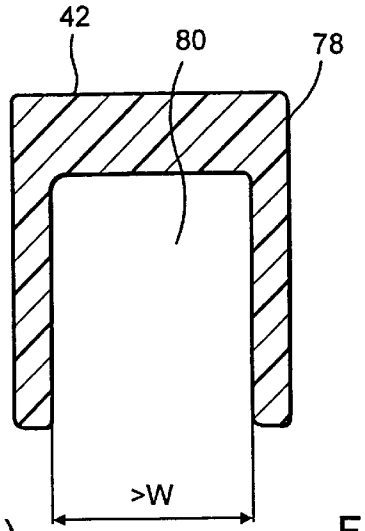
Figure 5C:
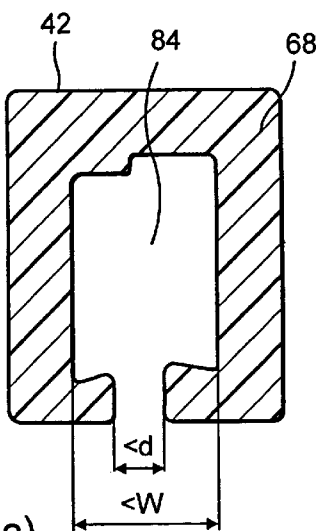

FIGS. 5(*a*), 5(*b*) and 5(*c*) are a side by side comparison of the various sections of the slider. FIG. 5(*a*) shows a cross-section of the closing end 44 of the slider 42. The closing end opening 82 has a width "w" and the distance between the retaining shoulders is "d". FIG. 5(*c*) shows a cross-section of the opening end 68 of the slider 42. The width of the opening 84 of the opening end 68 is less than the width of the opening 82 of the closing end 44 and the distance between the retaining shoulders is less than at the closing end. As discussed above, this configuration is opposite to that found in prior art sliders. In prior art sliders, the closing end is narrower than the opening end in order to force the profiles into an interlocked condition when the slider is moved in the closing direction. Because the present invention uses a lever/fulcrum action to manipulate the zipper, however, the opening end is in fact the narrower end.

FIG. 5(*b*) shows a cross-section of the cental section 78 of the slider 42. As is clear from the figure, the central section 78 may have no retaining shoulders and the central chamber 80 is wider than the closing end opening 82. As mentioned above, this configuration provides sufficient room to allow for smooth opening and closing of the zipper.

FIG. 6 shows a plastic bag 86 with the slider 42 disposed at the top. To open the zipper 10, the slider 42 is simply moved along the zipper 10 in the opening direction "O". To close the zipper 10, the slider 42 is moved along the zipper 10 in the closing direction "C".

The present invention is not limited to the foregoing embodiment. Any number of slider and zipper configurations may be used to practice the present invention.

Figure 7A:
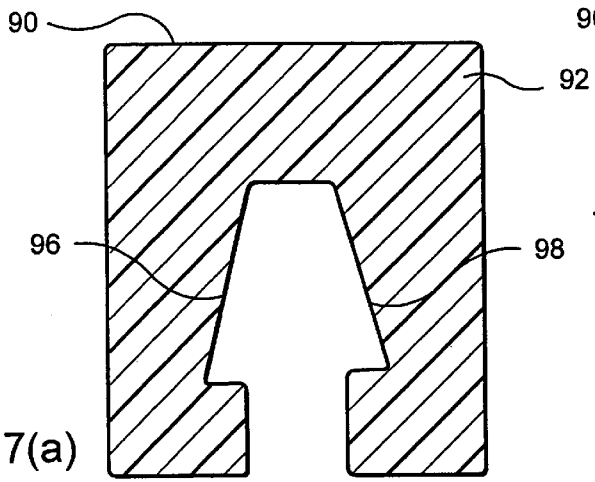
FIG. 7(*a*) is a cross-sectional view of the closing end of a slider in accordance with a second embodiment of the present invention.
Figure 7B:
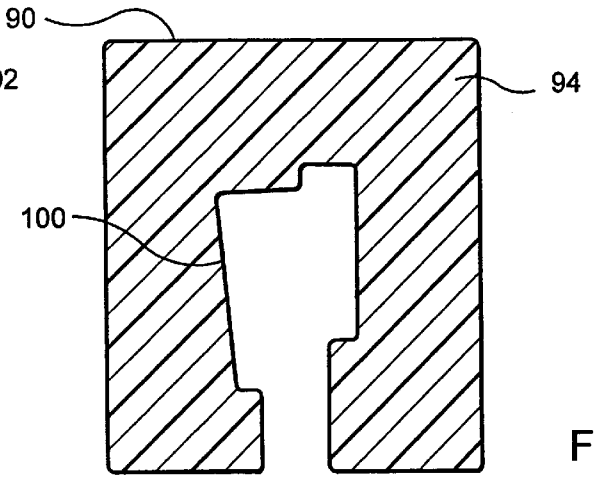

For example, FIGS. 7(*a*) and 7(*b*) show, respectively, cross-sections of the closing end 92 and opening end 94 of a slider 90 in accordance with a second embodiment of the present invention.

The slider of FIGS. 7(*a*) and 7(*b*), while operating in the same basic manner, differs in some aspects from the slider of FIGS. 2 and 3. For example, at the closing end 92 the second slider arm inner surface 96 is longer than the first slider arm inner surface 98. The slider 90 can thus accommodate a zipper having one profile longer than the other, such as the profile shown in FIG. 8. Additionally, at the opening end 94 the second slider arm inner surface 100 is beyond parallel, thus allowing for greater pivoting of the profiles.

Nor is the present invention limited to the zipper of FIG. 1. Any interlocking zipper which allows for pivoting of the profiles may be used to practice the present invention.

Figure 8:
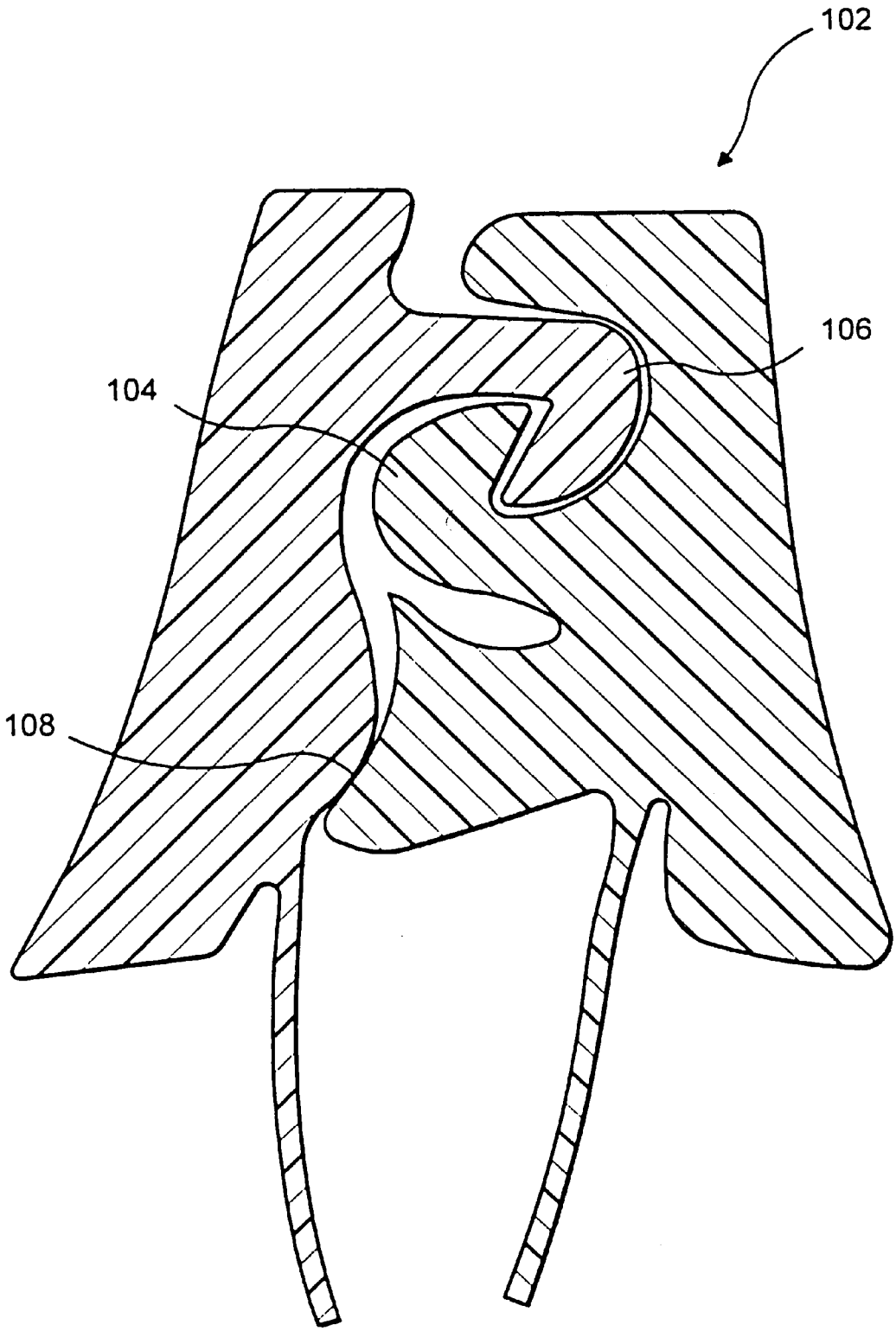
FIG. 8 is a cross-sectional view of a zipper in accordance with a third embodiment of the present invention.

For example, FIG. 8 shows a cross-section of an zipper 102 which has hooking interlocking members 104, 106 and a fulcrum 108 offset to the left. In the zipper 110 of FIG. 9, the bases 112, 114 of the zipper 110 are parallel, and the fulcrum 116 is equidistant between the profile bases. In addition, the fulcrum members 118, 120 are not convex/concave as in the zipper of FIG. 1, but are flat. Thus, the present invention is not limited to profiles having mating convex/concave fulcrum members. However, use of convex/concave fulcrum members does provide for a higher level of leak protection.

Figure 9:
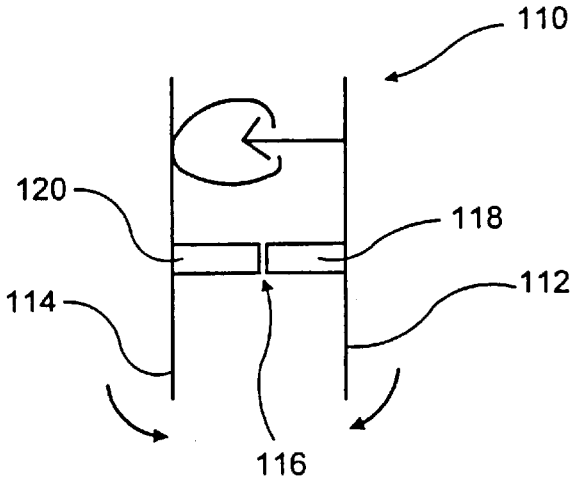
FIG. 9 is a cross-sectional view of a zipper in accordance with a fourth embodiment of the present invention.
Figure 10:
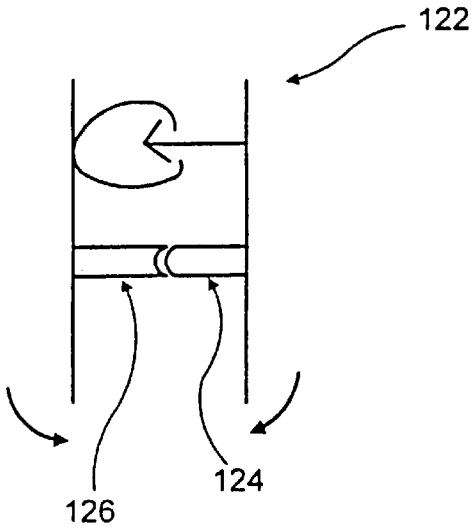
FIG. 10 is a cross-sectional view of a zipper in accordance with a fifth embodiment of the present invention.
Figure 11:
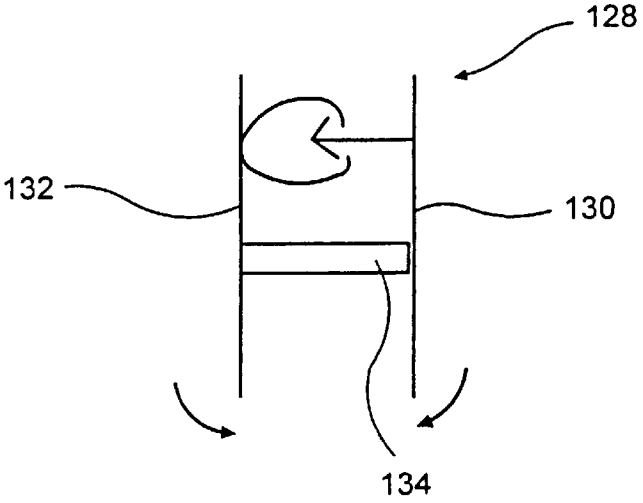
FIG. 11 is a cross-sectional view of a zipper in accordance with a sixth embodiment of the present invention.

The zipper 122 of FIG. 10 is identical to that of FIG. 8, except that the fulcrum members 124, 126 are concave/convex, and thus provide a better leak proof seal than the profile of FIG. 9. The zipper 128 of FIG. 11 uses parallel bases 130, 132 as well, but there is only one fulcrum member 134.

Also, while the zipper 10 has been depicted and described in the various embodiments with the interlocking members at the zipper top, above the base members, the reverse construction may also be utilized wherein the bases are above the interlocking members. That is, the zippers may generally be upside-down from the orientations shown.

Use of any of the profiles of FIGS. 8, 9, 10 or 11, or any other profile, would require some reconfiguration of the slider to open and close the zipper (such as re-shaping the slider arm inner surfaces), but any such reconfiguration would be obvious to one of ordinary skill in the art.

Figure 13:
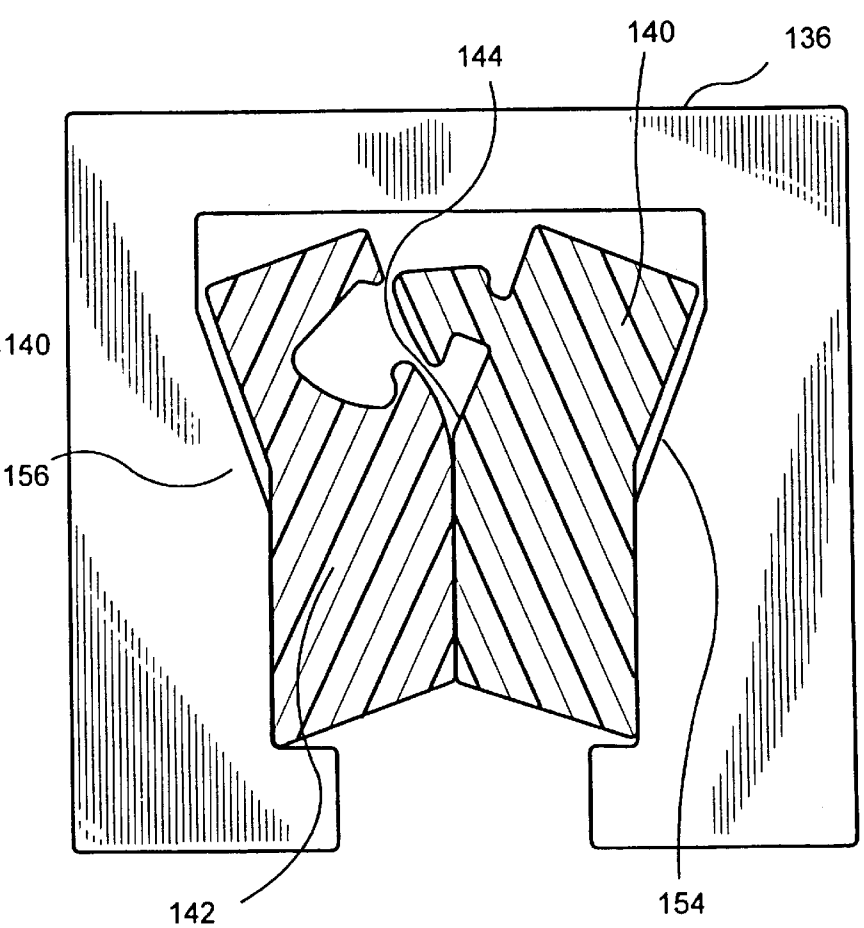
FIG. 13 is a view of the opening end of the slide zipper assembly in accordance with the seventh embodiment of the present invention.
Figure 12:
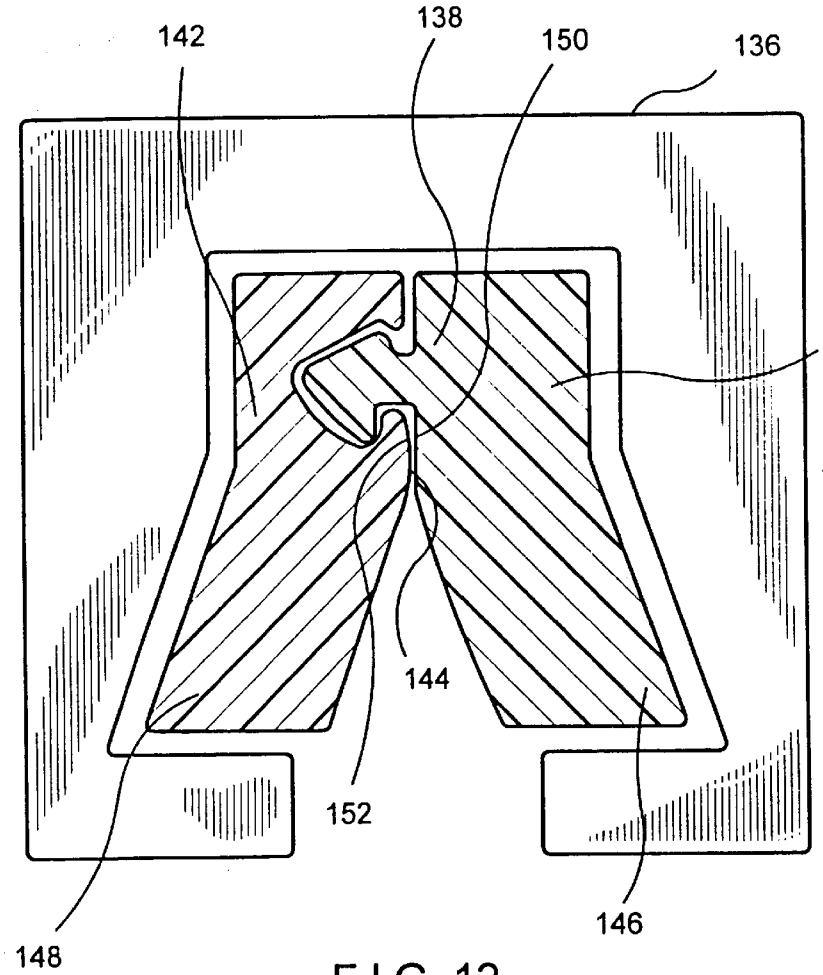
FIG. 12 is a view of the closing end of a slide zipper assembly in accordance with a seventh embodiment of the present invention.

FIGS. 12 and 13 show a slide zipper assembly in accordance with yet another embodiment of the present invention. As shown in FIG. 12, the slide zipper assembly comprises a slider 136 and a zipper 138 having a male profile 140 and a female profile 142. Unlike in previous embodiments, the profiles do not have discreet fulcrum members. Rather, portions 150, 152 of the profile bases 146, 148 are contoured to form a fulcrum at 144 when the profiles are interlocked. When the slider is moved in the opening direction, as shown FIG. 13, the change in configuration of the slider arm inner surfaces 154, 156 forces the profiles to pivot, or "rock", oppositely about the fulcrum 144 and become disengaged.

Thus, it is apparent that there are an infinite number of slider/zipper configurations which may be used to practice the present invention.

Modifications to the above would be obvious to those of ordinary skill in the art, but would not bring the invention so modified beyond the scope of the appended claims.

We claim:

1. A reclosable zipper comprising:

a first profile and a second profile;

said first profile including an interlocking member on a surface directed toward said second profile and a base directed away from said second profile;

said second profile including an interlocking member on a surface directed toward said first profile and a base directed away from said first profile, said first and second interlocking members being engageable with each other; and portions of at least one of the first and second profiles forming a fulcrum between said profiles, said fulcrum being disposed between said one of said first and second profiles' interlocking member and base, the other of said first and second profiles including a surface along which said fulcrum may be shifted so that said first profile may be pivoted by pushing said first profile base toward said second profile base so as to cause said interlocking members, when engaged, to disengage.

2. A reclosable zipper according to claim 1 wherein said second profile may be pivoted about said fulcrum by pushing an end of said second profile base, distal from said second interlocking member, toward said first profile so as to cause said interlocking members, when engaged, to disengage.

3. A reclosable zipper according to claim 2 wherein when said profiles are engaged said profile bases diverge in the direction of said distal ends.

4. A reclosable zipper according to claim 1 wherein said fulcrum forming portions further form a leak proof seal.

5. A reclosable zipper according to claim 1 wherein said profile bases are more rigid than said interlocking members.

6. A reclosable zipper according to claim 1 wherein at an end opposite to said first profile base, said first profile includes a latch member and at an end opposite to said second profile base, said second profile includes a receptor for said latch.

7. A slide zipper assembly comprising:

a reclosable zipper having a first profile and a second profile;

said first profile including an interlocking member on a surface directed toward said second profile and a base directed away from said second profile;

said second profile including an interlocking member on a surface directed toward said first profile and a base directed away from said first profile, said first and second interlocking members being engageable with each other;

portions of at least one of the first and second profiles forming a fulcrum between said profiles, said fulcrum being disposed between said one of said first and second profiles' interlocking member and base, the other of said first and second profiles including a surface along which said fulcrum may be shifted so that said first profile may be pivoted by pushing said first profile base toward said second profile base so as to cause said interlocking members, when engaged, to disengage;

a slider disposed for movement along said zipper, said slider including a top portion and first and second arms depending therefrom, said first and second arms disposed respectively adjacent said first and second profile bases;

wherein at an opening end of said slider an inner surface of said first slider arm is shaped to push said first profile base distal end towards said second profile so that as said slider is moved along said zipper in an opening direction opposite to said opening end said first profile pivots about said fulcrum, causing said interlocking members to disengage.

8. A slide zipper assembly according to claim 7:

wherein said second profile may be pivoted about said fulcrum by pushing an end of said second profile base, distal from said second interlocking member, toward said first profile so as to cause said interlocking members, when engaged, to disengage; and wherein at said slider opening end an inner surface of said second slider arm is shaped to push said second profile base distal end towards said first profile so that as said slider is moved along said zipper in said opening direction said second profile pivots about said fulcrum, causing said interlocking members to disengage.

9. A slide zipper assembly according to claim 8 wherein when said profiles are engaged said profile bases diverge in the direction of said distal ends.

10. A slide zipper assembly according to claim 8 wherein at an end opposite to said first profile base, said first profile includes a latch member and at an end opposite to said second profile base, said second profile includes a receptor for said latch and at said opening end, said slider top portion includes a downwardly extending shoulder that engages said first profile and urges said latch to disengage from said receptor.

11. A slide zipper assembly according to claim 7 wherein said fulcrum forming portions further form a leak proof seal.

12. A slide zipper assembly according to claim 7 wherein said fulcrum forming portions are pushed together as said profiles are disengaged.

13. A slide zipper assembly according to claim 7 wherein said slider is loaded onto said zipper with said profiles interlocked at the loading location.

14. A slide zipper assembly according to claim 7 wherein said profile bases are more rigid than said interlocking members.

15. A slide zipper assembly according to claim 7 wherein at a closing end of said slider each of said slider arm inner surfaces is shaped to push said profiles into engagement as said slider is moved in a closing direction opposite to said opening direction.

16. A slide zipper assembly according to claim 15 wherein said closing end is wider than said opening end.

17. A slide zipper assembly according to claim 15 wherein a central section of said slider between said closing and opening ends is wider than both said closing and opening ends.

18. A slide zipper assembly according to claim 15 wherein said slider further includes retaining shoulders on said slider arms directed towards each other at both said opening and closing ends for holding said slider on said zipper.

19. A slide zipper assembly according to claim 18 wherein said retaining shoulders are discontinuous along the length of said slider.

20. A slide zipper assembly according to claim 18 wherein said retaining shoulders force said profile base distal ends apart when said slider is pulled in the direction of said slider top.

21. A slide zipper assembly according to claim 18 wherein the retaining shoulder on said first slider arm at said opening end urges said first profile upwardly out of engagement with said second profile as said slider is moved in said opening direction.

* * * * *